US007654215B2

(12) United States Patent
Vitale

(10) Patent No.: US 7,654,215 B2
(45) Date of Patent: Feb. 2, 2010

(54) DIVER PROPULSION SYSTEM WITH SEPARATE BATTERY AND MOTOR-TRANSMISSION MODULES

(76) Inventor: Dean A. Vitale, 19700 Franjo Rd., Miami, FL (US) 33157

( * ) Notice: Subject to any disclaimer, the term of this patent is extended or adjusted under 35 U.S.C. 154(b) by 0 days.

(21) Appl. No.: 12/217,237

(22) Filed: Jul. 2, 2008

(65) Prior Publication Data

US 2009/0056613 A1 Mar. 5, 2009

Related U.S. Application Data

(63) Continuation-in-part of application No. 11/895,083, filed on Aug. 23, 2007, which is a continuation of application No. 11/119,527, filed on Apr. 29, 2005, now Pat. No. 7,270,074.

(51) Int. Cl.
*B63C 11/46* (2006.01)

(52) U.S. Cl. ..... 114/315; 440/6

(58) Field of Classification Search ..... 114/315; 405/185, 186, 187; 440/6
See application file for complete search history.

(56) References Cited

U.S. PATENT DOCUMENTS

| | | | | | |
|---|---|---|---|---|---|
| 3,014,448 | A | * | 12/1961 | Fogarty et al. | 114/315 |
| 3,034,467 | A | * | 5/1962 | Pestronk | 440/6 |
| 3,128,739 | A | * | 4/1964 | Schultz | 114/315 |
| 3,329,118 | A | * | 7/1967 | Strader | 114/315 |
| 3,916,814 | A | * | 11/1975 | Bardoni et al. | 114/315 |
| 3,995,578 | A | * | 12/1976 | McCullough | 440/6 |
| 4,220,110 | A | * | 9/1980 | Roberson et al. | 114/315 |
| 4,305,012 | A | * | 12/1981 | Friedel | 440/6 |
| 4,864,959 | A | * | 9/1989 | Takamizawa et al. | 114/315 |
| 5,105,753 | A | * | 4/1992 | Chih et al. | 114/315 |
| 5,365,868 | A | * | 11/1994 | Culotta | 114/315 |
| 6,823,813 | B2 | * | 11/2004 | Mazin | 114/315 |
| 7,270,074 | B2 | * | 9/2007 | Pradetto et al. | 114/315 |
| 7,527,011 | B2 | * | 5/2009 | Smith | 114/315 |

* cited by examiner

*Primary Examiner*—Lars A Olson
(74) *Attorney, Agent, or Firm*—Tod R. Nissle, P.C.

(57) ABSTRACT

A diver propulsion system includes separate operatively associated battery, motor, transmission, and clutch modules.

1 Claim, 7 Drawing Sheets

FIG. 1
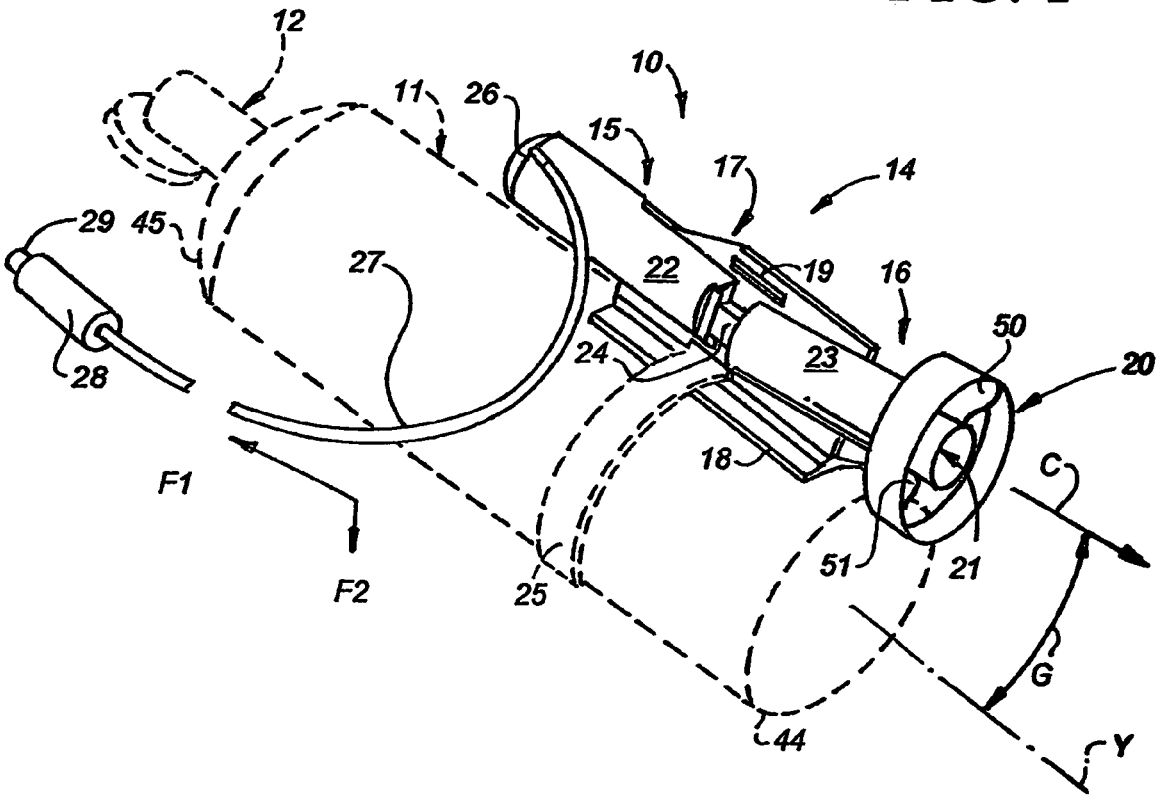
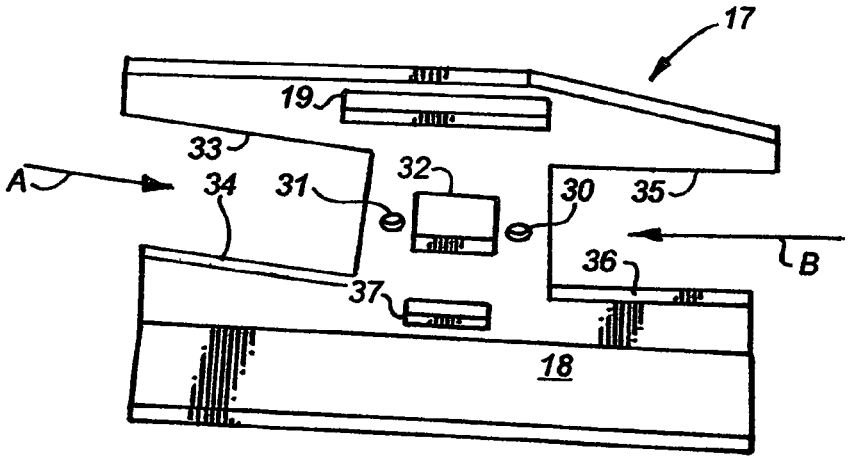
FIG. 2

FIG. 3
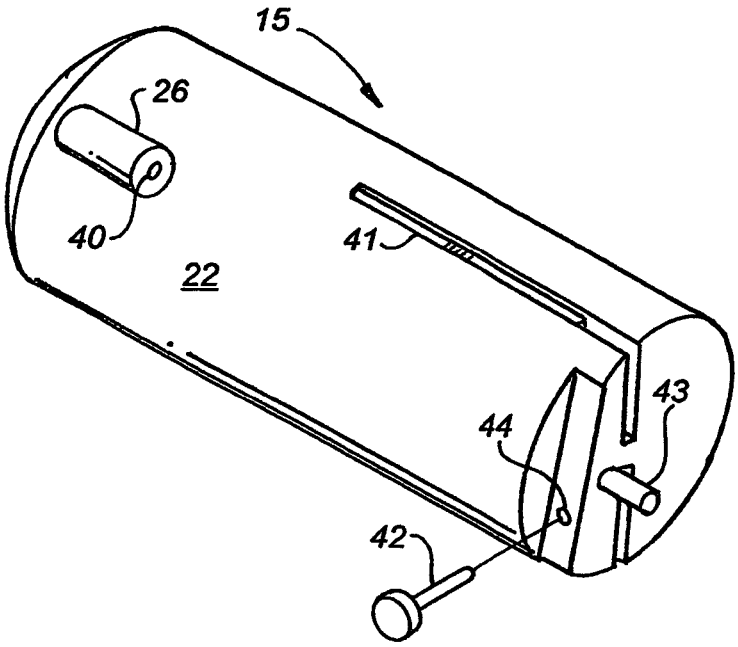
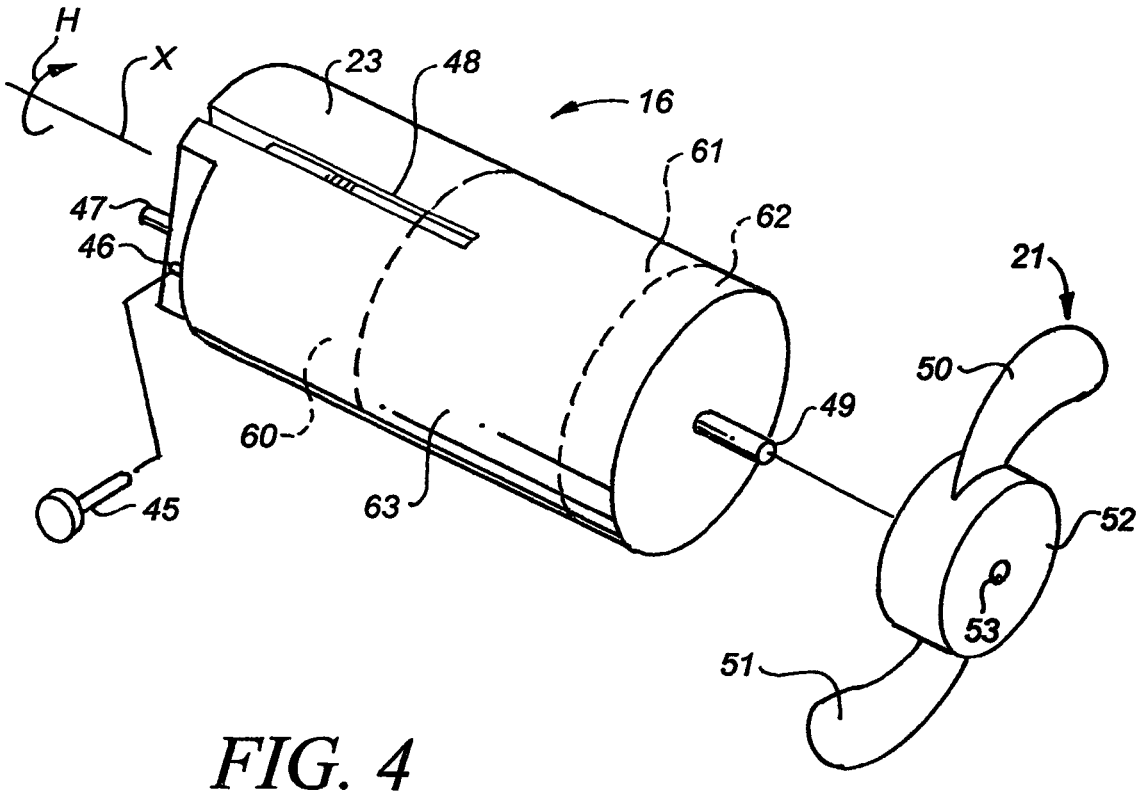
FIG. 4

DIVER PROPULSION SYSTEM WITH SEPARATE BATTERY AND MOTOR-TRANSMISSION MODULES

This is a continuation-in-part of pending U.S. patent application Ser. No. 11/895,083 filed Aug. 23, 2007 which is a continuation of patent application Ser. No. 11/119,527 filed Apr. 29, 2005, now issued U.S. Pat. No. 7,270,074B2.

This invention pertains to diving equipment.

More particularly, the invention pertains to a propulsion system for scuba divers.

Providing supplemental propulsion for divers, in particular scuba divers, is desirable for a variety of reasons. For example, supplemental propulsion enables a scuba diver to direct to other tasks energy that normally would be expended in swimming or maneuvering through water. One kind of well known propulsion unit is a "scooter" that is positioned in front of a scuba diver. The scooter includes handles at the rear of the scooter. A diver grasps the handles and the scooter pulls the diver through the water. While scooters are useful, the size of a scooter limits the mobility in the water of a diver and makes transport and storage of the scooter cumbersome. Scooters allow no "hands-free" operations, if necessary.

Accordingly, it would be highly desirable to provide an improved supplemental propulsion system for a scuba diver that would (1) enhance mobility, (2) decrease oxygen consumption, (3) allow "hands-free" operation, and (4) be compact and lightweight in storage use.

Therefore, it is a principal object of the instant invention to provide an improved underwater propulsion system.

A further object of the invention is to provide an improved propulsion system that can be readily assembled, installed, and utilized by a scuba diver.

Another object of the invention is to provide an improved propulsion system that provides a high thrust to weight ratio.

These and other, further and more specific objects and advantages of the invention will be apparent to those skilled in the art from the following detailed description thereof, taken in conjunction with the drawings, in which:

FIG. 1 is a perspective view illustrating a propulsion system constructed in accordance with the principles of the invention;

FIG. 2 is a perspective view illustrating a bracket utilized to hold the motor-transmission and battery housings of the propulsion system of FIG. 1;

FIG. 3 is a perspective view illustrating a battery module utilized in the propulsion system of FIG. 1;

FIG. 4 is a perspective view illustrating a motor-transmission module utilized in the propulsion system of FIG. 1;

Figure 5:
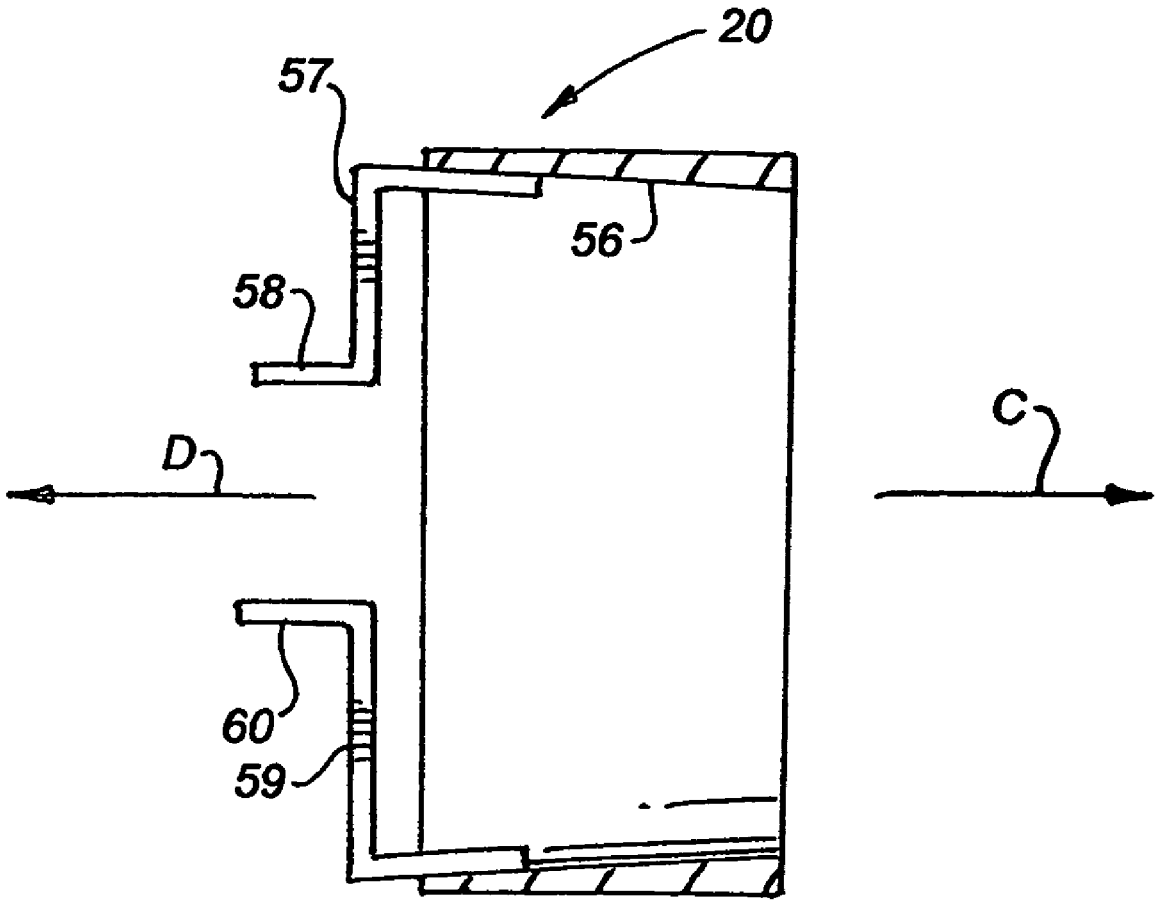
FIG. 5 is a section view illustrating the propeller shroud in the propulsion system of FIG. 1.

Briefly, in accordance with the invention, provided is an improved scuba diving propulsion system. The system comprises a tank of breathable gas; a regulator attached to the tank to supply breathable gas to a diver; and, a propulsion apparatus. The propulsion apparatus comprises a housing; apparatus securing the propulsion apparatus to the tank; a battery mounted on the housing; and, a motive power module mounted on the housing. The motive power module includes an electric motor; a transmission operatively associated with the motor to increase torque; a propeller shaft operatively associated with the transmission; and, a propeller mounted on the propeller shaft.

In another embodiment of the invention, provided is an improved propulsion unit for scuba diving breathing equipment. The breathing equipment includes a tank of breathable gas and a regulator attached to the tank to supply breathable gas to a diver. The propulsion unit includes a housing; apparatus to secure the propulsion system to the tank; a battery module detachably mounted on the housing; and, a motive power module detachably mounted on the housing and spaced apart from the battery module. The power module includes an electric motor; a transmission operatively associated with the motor; a propeller shaft operatively associated with the transmission; and, a propeller mounted on the propeller shaft.

In a further embodiment of the invention, provided is an improved propulsion unit for scuba diving breathing equipment. The breathing equipment includes a tank of breathable gas and a regulator attached to the tank to supply breathable gas to a diver. The improved propulsion unit includes a housing; apparatus to secure the propulsion system to the tank; an electrical connector mounted on the housing; a battery module mounted on the housing and electrically attached to the electrical connector; and, a motive power module mounted on the housing and spaced apart from said battery module. The motive power module includes an electric motor, a transmission operatively associated with the motor, a propeller shaft operatively associated with the transmission, and, a propeller mounted on the propeller shaft. The power module is electrically attached to the electrical connector such that electricity flows from the battery module through the electrical connector to the power module.

In still another embodiment of the invention, we provide an improved scuba diving propulsion system. The system comprises a tank of gas having a first end and a second end and charged with breathable gas; a regulator attached to the tank to supply the breathable gas to a diver; and, a propulsion apparatus having a selected weight. The propulsion apparatus comprises a housing; apparatus securing the propulsion apparatus to the tank; a battery mounted on the housing; and, a motive power module mounted on the housing and including a propeller. The housing includes a foot shaped and dimensioned to conform to the tank, to contact the tank intermediate the first and second ends, and to distribute the weight over a selected area on the tank.

In a further embodiment of the invention, provided is a scuba diving propulsion system comprising a propulsion apparatus for a tank. The apparatus comprises a bracket; apparatus securing the bracket to the tank; a battery mounted on the bracket; and, a motive power module mounted on the bracket. The motive power module includes a self-contained electric motor unit including a first housing; a self-contained transmission unit including a second housing, mounted exterior of the first housing, and operatively associated with the motor unit to increase and transmit the torque produced by the motor unit, a self-contained clutch unit including a third housing, mounted exterior of the first and second housings, and operatively associated with the transmission unit to transmit torque produced by the transmission unit; a propeller shaft operatively associated with the transmission unit and clutch unit to receive torque produced by the transmission unit to rotate. The propeller shaft includes a proximate end operatively associated with said transmission unit, and a distal end. A propeller is mounted on the distal end of the propeller shaft. The clutch unit disengages the transmission unit in the event rotation of the propeller and shaft is prevented while the motor unit and transmission unit are producing torque.

Turning now to the drawings, which depict the presently preferred embodiments of the invention for the purpose of illustrating the practice thereof and not by way of limitation of the scope of the invention and in which like reference characters refer to corresponding elements throughout the several views, FIGS. 1 to 5 illustrate a scuba diver propulsion system constructed in accordance with the invention and generally indicated by reference character 10. The propulsion system 10 includes a tank 11 charged with breathable nitrogen, oxygen, air or other generally non-toxic breathable gases. Tank 11 includes a distal end 44 and a proximate end 45. A regulator 12 is connected to proximate end 45 in conventional fashion to provide to a diver at a desired flow rate breathable gas from tank 11. The regulator is attached to a hose and mouthpiece (not shown) in conventional fashion. The construction of regulators 12 and tanks 11 is well known and is not discussed in detail herein.

The propulsion system 10 also includes a propulsion unit 14. Unit 14 includes bracket 17. Battery module 15 and motor-transmission-propeller shaft module 16 are slidably detachably mounted on bracket 17 in the manner discussed below. Strap 25 extends through opening 37 in bracket 17 and secures bracket 17 in position on tank 11. At least one end of strap 25 preferably includes a buckle to facilitate the attachment and removal of strap 25 from tank 11. Foot 18 of bracket 17 is shaped to conform to the outer surface of tank 11 at a location generally intermediate ends 44 and 45. Positioning foot 18 intermediate ends 44 and 45 facilitates the even distribution of the weight of unit 14 over the length of tank 11, and facilitates balancing the weight of unit 14 on the back of a diver such that the weight of unit 14 is not substantially concentrated at either end 44, 45 of tank 11.

Rectangular opening 32 of bracket 17 (FIG. 2) is shaped to receive electrical connector 24 (FIG. 1). Connector 24 includes a pair of openings (not visible) that each slidably receive one of connector pins 43 (on battery module 15) and 47 (on motor-transmission module 16). Connector 24 permits electricity to flow from battery module 15, through pin 43, through connector 24, and through pin 47 to motor-transmission module 16. Rectangular opening 19 in bracket 17 functions as a handle.

The U-shaped opening on the left of bracket 17 in FIG. 2 includes parallel edges or tracks 33, 34 each shaped and dimensioned to slidably engage one of an opposing pair of parallel slots 48 formed in the cylindrical shaped surface 23 of module 16 such that module 16 can be slidably inserted in bracket 17 in the direction of arrow A (FIG. 2) to the position illustrated in FIG. 1. In FIG. 4 one slot 48 is visible while the other is on the bottom of module 16 in FIG. 4 and is not visible. Each slot 48 has an equivalent shape and dimension. When module 16 is slidably inserted in bracket 17 to the position shown in FIG. 1, aperture 46 in module 16 is aligned with aperture 31 in bracket 17 and quick release pin 45 is inserted through aperture 46 into aperture 31 to secure module 16 in position on bracket 17. Any desired fastening system can be utilized to secure module 16 on bracket 17. In FIG. 1, module 16 is rotated 180 degrees about axis X from the orientation shown in FIG. 4.

The U-shaped opening on the right of bracket 17 in FIG. 2 includes parallel edges or tracks 35, 36 each shaped and dimensioned to slidably engage one of an opposing pair of parallel slots 41 formed in the cylindrical shaped surface 22 of module 15 such that module 15 can be slidably inserted in bracket 17 in the direction of arrow B (FIG. 2) to the position illustrated in FIG. 1. In FIG. 3, one of slots 41 is visible while the other slot is located on the bottom of module 15 in FIG. 3 and is not visible. Each slot 41 has an equivalent shape and dimension. When module 15 is slidably inserted in bracket 17 to the position shown in FIG. 1, aperture 44 in module 16 is aligned with aperture 30 in bracket 17 and quick release pin 42 is inserted through aperture 44 into aperture 31 to secure module 16 in position on bracket 17. Any desired fastening system can be utilized to secure module 16 on bracket 17.

Battery module 15 includes connector 26 with cylindrical socket or opening 40. Opening 40 is shaped to receive slidably an electrical connector pin (not shown) at the distal end of control cable 27. The proximate end of cable 27 includes a handle 28 and a control button 29. A diver depresses and releases button 29 to activate a switch that permits electricity to flow from module 15, through pin 43, through connector 24, and through pin 49 to electric motor 60 in module 16. When a diver again depresses and releases button 29, the switch is closed or otherwise deactivated and electricity does not flow from module 15 to module 16. Any desired mechanism can be selected and used to activate and deactivate the flow of electricity from module 15 to module 16.

When electricity flows from module 15 to module 16, motor 60 operates. Transmission 61 is connected to and operatively associated with motor 60. Transmission 61 functions to increase the torque produced by motor 60. Transmission 61 can be constructed in any desired fashion, but typically includes a system of interconnected gears. Propeller shaft 49 is connected to and turned by transmission 61. Consequently, when motor 60 is running, shaft 49 is rotated and the propeller 21 mounted on shaft 49 rotates simultaneously with shaft 29.

Propeller 21 includes hub 52 and typically also includes at least a pair of blades 50, 51 connected to and outwardly extending from hub 52. The shape and dimension of blades 50 and 51 can be altered as desired to facilitate the accomplishment of any desired function of blades 50 and 51. Rotation of blades 50 and 51 displaces water in the direction of arrow C in FIG. 1 to produce a force F1 acting in a direction opposite that of arrow C to propel a diver wearing tank 11 in a direction opposite that of arrow C. The longitudinal axis or centerline Y of cylindrical tank 11 is shown in FIG. 1. The direction indicated by arrow C in FIG. 1 is coincident with the longitudinal axis or centerline of cylindrical housing 23. Axis Y is not parallel to arrow C. Instead, there preferably is a small angle G in the range of one degree to thirty degrees, preferably five degrees to twenty degrees, most preferably ten to fifteen degrees, between axis Y and arrow C. This angle or cant of module 16 and the axis of rotation of shaft 49 causes F1 to act in a direction that is not parallel to the back of a diver wearing tank 11, but that is instead at an angle to and "pointing into" the back of the diver. Such cant of module 16 produces a force F2 that tends to press downwardly against the back of the diver and to prevent the diver from rising upwardly in the water.

As is illustrated in FIG. 5, the inner surface 56 of propeller shroud 20 is conically shaped such that water drawn through shroud 20 in the direction of arrow C accelerates in a venturi like fashion to facilitate the propulsion of a diver in the direction of arrow D. Legs 57 and 59 are attached to the inner surface 56 of shroud 20. Feet 58, 60 of legs 57 and 58, respectively, are attached to cylindrical surface 23 of module 16.

In use, strap 25 is utilized to secure removably propulsion unit 14 to a tank 11. When a diver uses two or more tanks 11, a propulsion unit 14 can be provided for each tank, a single propulsion unit 14 can be mounted at the center of the tanks (for example, when a diver uses two side-by-side tanks, housing 17 is configured such that unit 14 is mounted in between the tanks), or a housing 17 can be provided that is configured to be mounted on multiple tanks and that includes one or more propulsion units 14. Unit 14 preferably is (when tank 11 is secured on the back of a diver) positioned above the diver's spine or the center of the diver's back. Positioning unit 14 at a location laterally spaced apart from the center of the diver's back causes unit 14, when propeller 21 is operated, to generate forces that tend to turn a diver to one side. The generation of such forces is preferably avoided.

The negative buoyancy of unit 14 is presently typically about 4.8 pounds. An air bladder associated with tank 11 can, if desired, be inflated to offset such negative buoyancy.

Tank 11 (with unit 14 attached) is secured to the back of a diver using a conventional harness assembly (not shown) such that end 44 is adjacent the lower back of the diver and end 45 is adjacent the upper back of the diver. The diver holds grip 28 in one of his or her hands. When the diver is in the water, propeller 21 is activated by depressing and releasing button 29. Propeller 21 is turned off by again depressing and releasing button 29.

One advantage of the propulsion unit 14 is that battery module 15 is maintained separate from the motor-transmission module 16. This is preferred because the module 15 ordinarily generates hydrogen. Module 16 preferably includes a substance that absorbs hydrogen, and includes a pressure relief screw. Module 16 is changeable underwater.

Module 15 preferably includes a temperature sensor that, when a particular elevated temperature is detected by the sensor, turns off unit 14. When unit 14 is turned off, propeller 21 does not rotate, electricity is not being drawn from battery module 15, and the battery in module 15 cools down. The battery in module 15 preferably is a rechargeable battery.

If desired, means can be provided to install and remove pin 43 such that when the battery in module 15 is being charged, pin 43 is removed so there is no electrical connection between module 15 and connector 24. Once recharging is completed, the pin 43 is reinstalled to re-establish the electrical connection between module 15 and connector 24.

If desired, unit 14 can be constructed such that motor 60 and/or propeller 21 operates at two or more speeds. An appropriate control unit can be provided that enables a diver manually or otherwise to alter the speed at which propeller 21 turns.

Transmission 61 is an important component in unit 14 because it increases the torque derived from motor 60 and facilitates the production of the torque desired to turn propeller 21.

Propeller hub 52 is secured to shaft 49 with an aluminum shear pin (not shown) so that if blades 50 and 51 are caught and hub 52 will not rotate, the aluminum pin will shear to prevent damage to the motor 60 or transmission 61. Bundling motor 60, transmission 61, and propeller shaft 49 in a single module 16 facilitates the compact storage and use of unit 14 and also facilitates the ready assembly and disassembly of unit 14.

Figure 6:
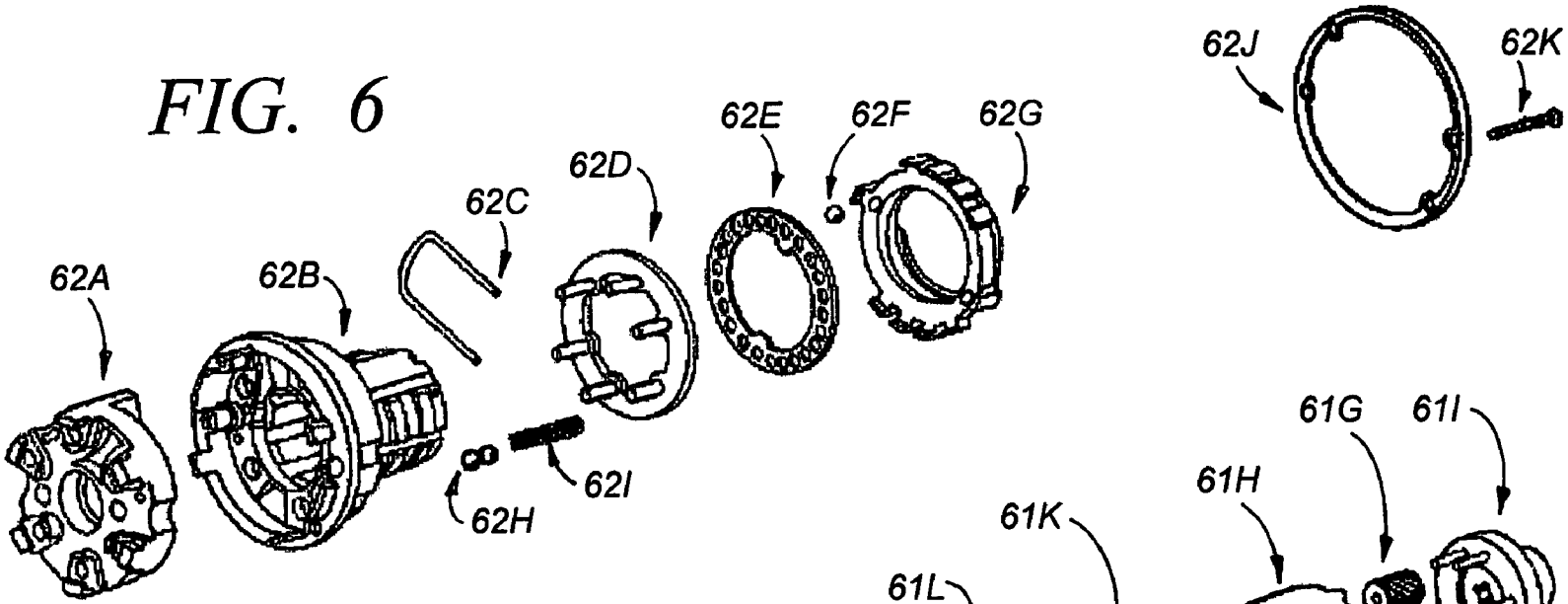
FIG. 6 is an exploded view illustrating the clutch in an alternate embodiment of the propulsion system of FIG. 1.
Figure 7:
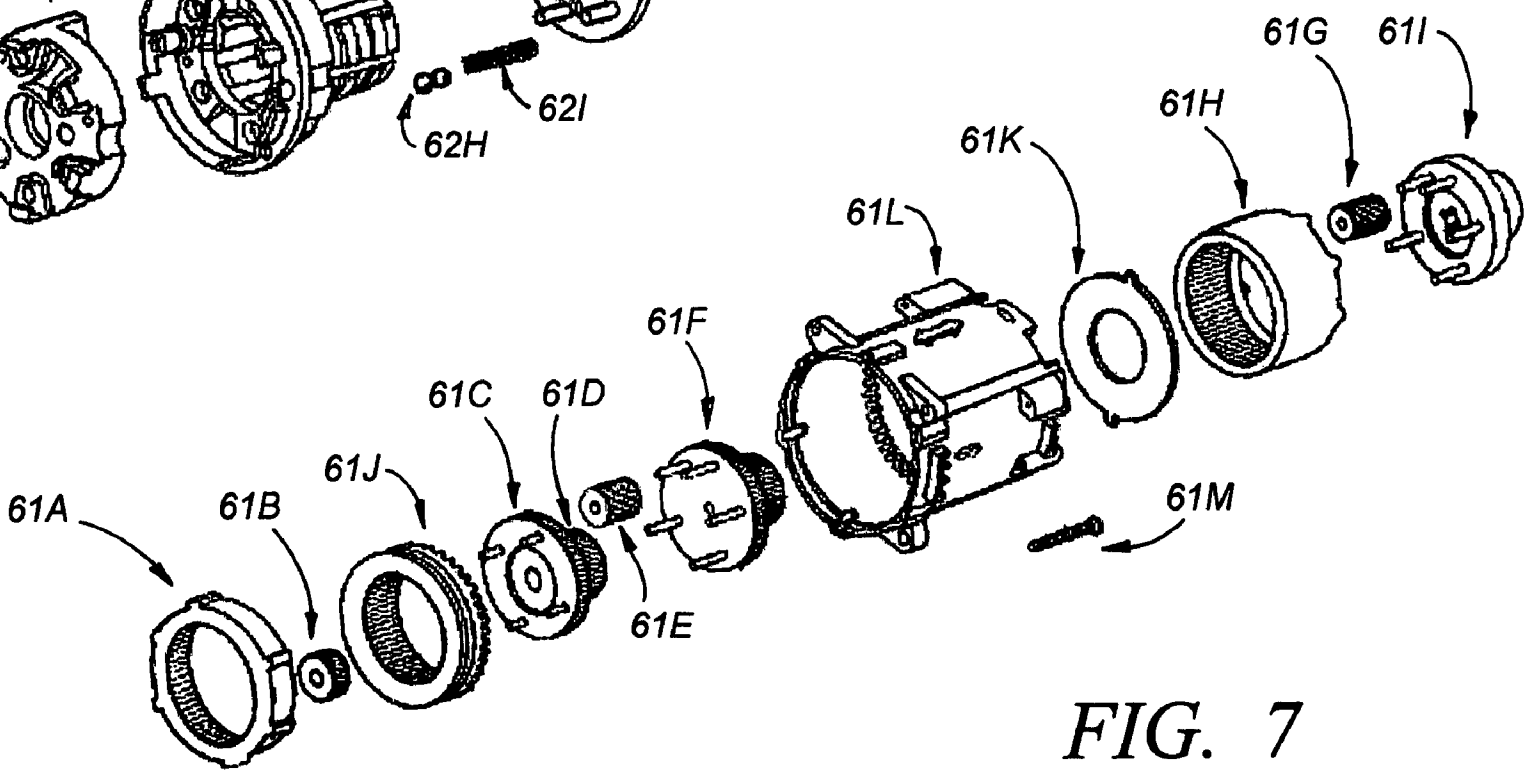
FIG. 7 is an exploded view illustrating the transmission in an alternate embodiment of the propulsion system of FIG. 1.
Figure 8:
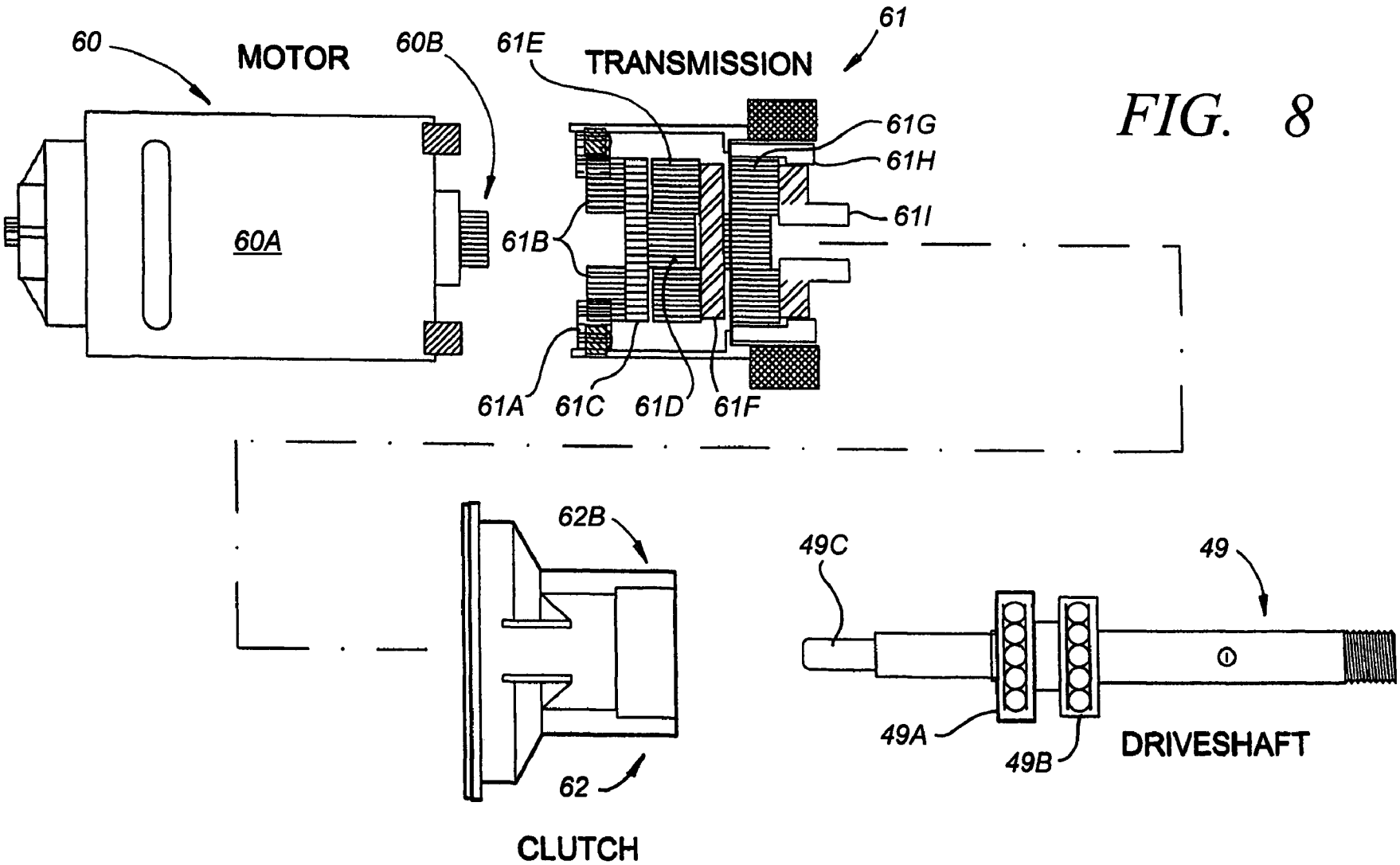
FIG. 8 is an exploded view illustrating the order of assembly of the motor, transmission, clutch, and drive shaft in said alternate embodiment of the propulsion system of FIG. 1.

An alternate embodiment of the motor-transmission module 16 is illustrated in FIGS. 6 to 10. As can be seen in FIG. 8, the motor-transmission module 16 includes motor unit 60, transmission unit 61, clutch unit 62, and drive shaft unit 49. Unit 49 includes a drive shaft with a proximate end 49C that has an orthogonal cross section and is slidably received by an orthogonal aperture in the center of drive hub 61I (FIG. 7) of transmission unit 61. A propeller is mounted on the distal end of the drive shaft of unit 49. The drive shaft is supported and permitted to rotate by sealed ball bearing assemblies 49A and 49B.

Motor unit 60 includes housing 60A and drive or "sun" gear 60B that is rotated by motor unit 60 and that engages and rotates drive or "planetary" gears 61B in transmission 61. Gears 61B are rotatably mounted on splined hub and, when gears 61B are rotated by sun gear 60B, engage and move over and around the inner circular toothed surface of stationary ring gear 61A. When gears 61B travel over the inner circular surface of gear 61A, they rotate splined hub 61C and the reduction or "sun" gear 61D fixedly mounted on hub 61C. When gear 61D turns, it causes reduction or "planetary" gears to travel around gear 61D and rotate "reaction" hub 61F and the sun gear fixedly secured to hub 61F. Hub 61F and its hub rotate simultaneously, as do hub 61C and sun gear 61D. When the sun gear on hub 61F rotates, it causes reaction or "planetary" gears 61G to travel around the sun gear on hub 61F and to move over and around the inner circular toothed surface of reaction ring gear 61H. When planetary reaction gears 61G travel around the inner circular surface of ring gear 61H, gears 61G, since they are rotatably mounted on reaction drive hub 61I, cause drive hub 61I to rotate.

An exploded view of the clutch unit 62 is depicted in FIG. 6 and includes pressure plate 62A, support housing 62B, drive shaft retaining clip 62C, spring plate 62D, adjuster plate 62D, adjuster ball 62F, clutch adjustment cam 62G, a set of pawl lock ball bearings 62H, and tension spring 621, support plate 62J, and screw 62K (of which there are four). As would be appreciated by those of skill in the art, the clutch unit 62 includes multiple tension springs 621 and multiple sets of bearings 62H, and includes multiple screws 62K used to attached the clutch unit 62 to support housing 61L.

An exploded view of the transmission unit 61 is depicted in FIG. 7 and includes stationary ring gear 61A, planetary drive gear 62B (of which there are four), splined sliding ring gear (speed selector) 61J, splined hub drive 61C, sun gear 61D fixedly mounted on drive 61C, planetary reduction gear 61E (of which there are five) rotatably mounted on sun gear 61F including hub gear fixedly mounted on gear 61F, planetary reaction gear 61G rotatably mounted on drive hub 61I, support housing 61L, thrust washer 61K, ring reaction gear 61H, and screw 61M (of which there are four) to secure housing 61L to housing 60A.

Figure 9:
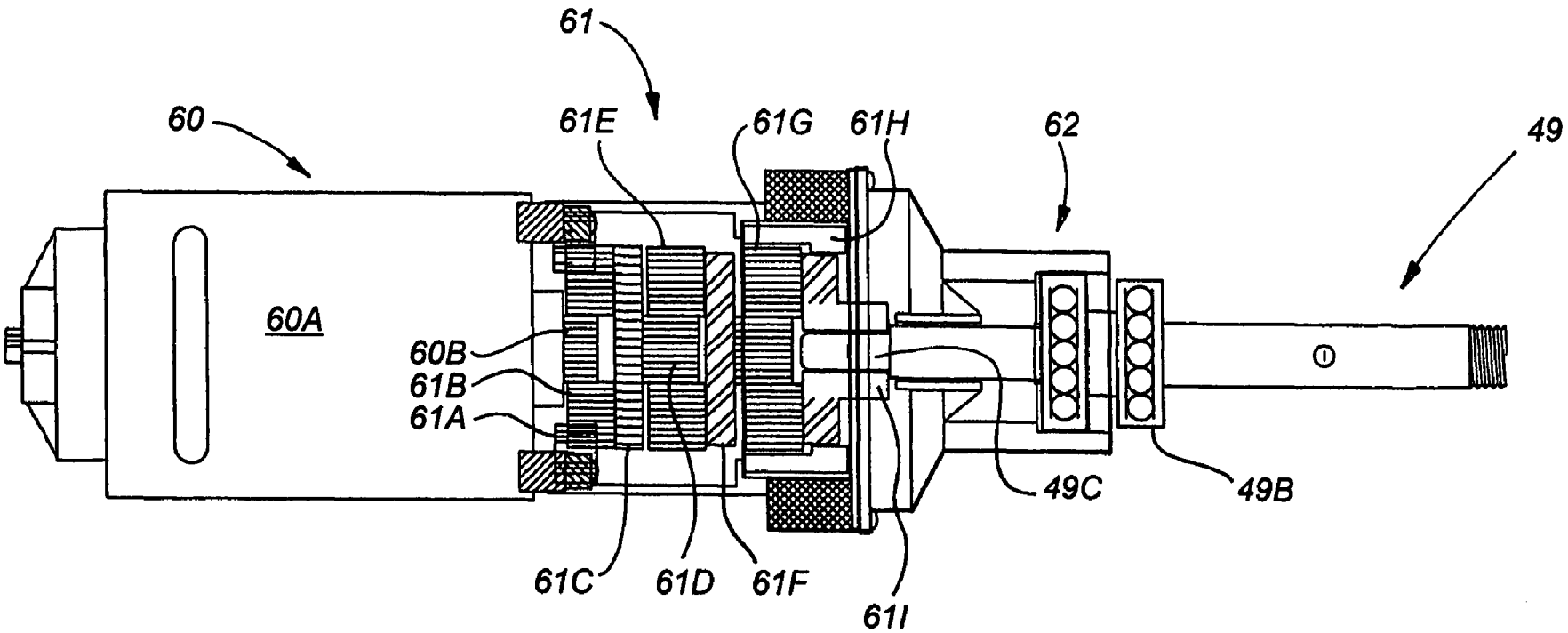
FIG. 9 is a side partial section view illustrating the motor, transmission, clutch, and drive shaft assembled in said alternate embodiment of the propulsion system of FIG. 1; and, FIG. 10 is a side partial section view illustrating the interface between the clutch and transmission in said alternate embodiment of the propulsion system of FIG. 1.

FIG. 9 illustrates the motor 60, transmission unit 61, clutch unit 62, and drive shaft unit assembled.

Figure 10:
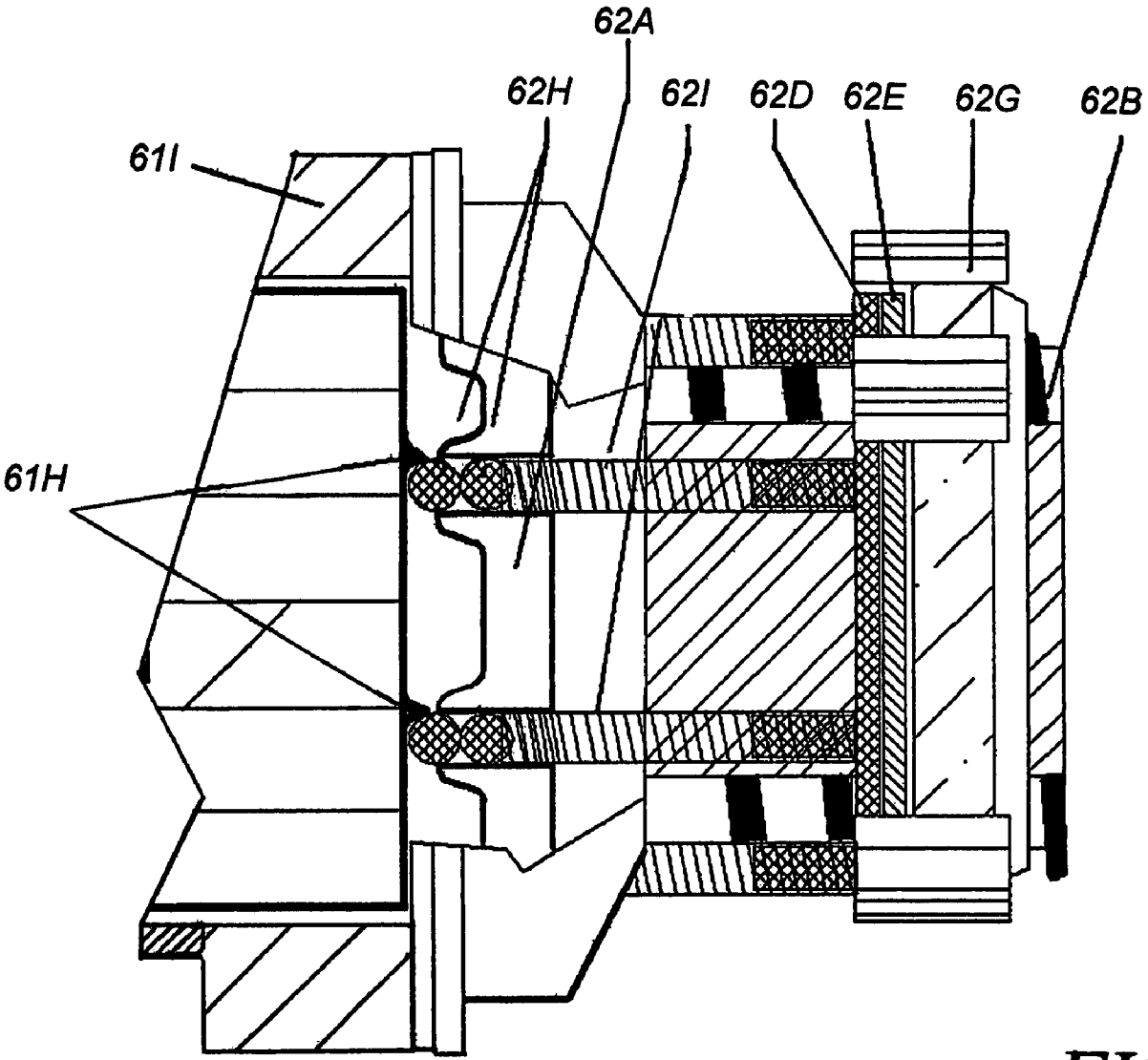

FIG. 10 illustrates the interface between the clutch unit 62 and transmission unit 61 to better explain how the clutch unit 62 operates to disengage the propeller shaft from the motor unit 60 and transmission unit 61 when the propeller shaft is caught in sea weed and is prevented from rotating normally, or, when the propeller shaft is otherwise prevented from turning. During normal operation, when the propeller is free to turn, the spring tension provided by springs 62I on bearings 62H holds the locking pawls on ring gear 61H stationary. This permits gear 61F to turn planetary gears 61G such that gears 61G move around the toothed interior of ring gear 61H and turn drive hub 61I and, consequently, the propeller shaft. In the event the propeller is caught in sea weed or is otherwise prevented from turning, the tension provided by springs 62! Is overcome, the locking pawls on ring gear 61H are released, and ring gear 61H rotates about the planetary gears 61G so that rotation forces are transmitted from the sun gear on hub

61F to ring gear 61H. After the propeller is freed and can turn normally, springs 621 and ball bearings 62H function to re-engage the pawls and stop ring gear 61H from rotating, which permits motive power from motor 60 and transmission 61 to rotate once again the propeller shaft and the propeller mounted on the distal end of the propeller shaft.

Motor unit 60, transmission unit 61, clutch unit 62, and drive shaft unit 49 are four self-contained modular units that are connected together in the manner described above to produce motor-transmission module 16. The motor housing 60A does not function to secure said modular units together. The transmission unit 61, clutch unit 62, and drive shaft unit 49 are mounted on the outside, or exterior of, housing 60A.

The motor in unit 60 presently preferably, but not necessarily, comprises a one and three-sixteenths inch diameter by three and five-eighths inches long, miniature two speed motor with a permanent magnetic field, brush contacts, and commutated armature. The motor is mounted in a steel housing 60A.

The transmission unit 61 presently preferably, but not necessarily, comprises a two and one eighth inch diameter by two inch long, two-speed, miniature transmission with steel and nylon gear assemblies and three separate planetary gear sets, namely, drive, reduction, and reaction. In one preferred embodiment of the invention, only a single speed transmission unit is required, in which case the second gear set in the transmission is eliminated.

The clutch unit 62 presently preferably, but not necessarily, includes a molded plastic housing.

The drive shaft in unit 49 comprises a corrosion resistant steel (CRES 316) that is presently preferably, but not necessarily, three-eighths inch in diameter by four and three-eighths inches long. The drive shaft utilizes a one-eighth inch bayonet drive system with a three-eighths inch-twenty-four thread configuration to lock the propeller.

The design of the motor-transmission module 16 set forth in FIGS. 6 to 10 facilitates the production of a small, lightweight propulsion unit in accordance with the invention. The motor-transmission module 16 weighs significantly less than trolling and other underwater motors utilized in the prior art, and does not require the use of a motor housing to contain the transmission and other components of the motor-transmission unit.

One particular unexpected and unpredicted benefit discovered after the invention was developed is that a motor-transmission assembly can be utilized that weight much less than conventional motor-transmission assemblies utilized on underwater propulsion units.

Unless reasons exist to the contrary, judicial notice is taken of the following facts:

1. A dominant long felt trend exists in connection with underwater propulsion units to utilize the housing in such units to retain and mount internally the transmission and other components other than the motor. This trend has occurred over an extended period of time, is followed by a large number of individuals in the pertinent art, and likely can be demonstrated by a significant number of references. A countervailing trend, if any, to placing the motor-transmission-clutch in a single housing that circumscribes and holds the same is believed to be much weaker or to be obfuscated among other trends in the art.
2. Common sense judgment requires that valid reasoning justifying such judgment be set forth.
3. There is no problem or motivation recognized in the diving art at the time of the invention that provides significant impetus for the development of the invention. Conventional diving propulsion units have long been accepted.
4. There is no problem or motivation recognized in the diving art at the time of the invention that suggests a readily apparent specific set of solutions, one of which is the invention. Conventional diving propulsion units have long been accepted.
5. There is no problem in the diving art at the time of the invention that suggests altering or adding to the conventional diving propulsion equipment. Conventional diving propulsion equipment has long been accepted.
6. The TSM test, per KSR, can provide helpful insight into evaluating the obviousness of the invention.
7. There is no reason not to use the TSM test in evaluating the obviousness of the invention described and claimed herein.
8. Motivation. Making something better is a broad, general, long-existing motivation that applies to each invention. Broad, general, long-existing motivations likely provide little significant impetus to produce an invention. For example, in the exercise machine art, one broad, general, long-existing motivation is to make exercise machines versatile, so that more than one exercise can be produced on an exercise machine. This motivation typically provides little significant impetus to produce an invention. If, on the other hand, an exercise machine produces a greater than normal number of injuries, such a problem is more specific and provides stronger impetus to improve the machine.
9. Assessing Weight Accorded a Problem or Motivation. The weight or importance of a problem or motivation in leading to an invention is apprised by evaluating by (1) how long the problem has existed, (2) the importance, and hence the driving force, of the problem or motivation, (3) whether the problem or motivation reasonably suggests the invention, (4) whether the motivation reasonably suggests a set of solutions of which the invention is one, (5) the trends, if any, produced by the problem or motivation, and (6) other solutions produced in response to the motivation or problem. With respect to (1) above in this paragraph, if a problem has long existed without producing a solution, that suggests the invention is not obvious. With respect to (2) above in this paragraph, if the problem appears to have little significance, that suggests it is not driving those of skill in the art toward the invention. With respect to (3) above, if the problem suggests a solution other than the invention, this suggests the problem is not driving those of skill in the art toward the invention. With respect to (4) above in this paragraph, if the problem suggests a set of solutions other than the invention, this suggest the problem is not leading toward the invention. With respect to (5) above, if the prevailing trends lead away from the invention or reinforce other solutions to the invention, that suggests the problem has not presented the invention as a solution. With respect to (6) above in this paragraph, other solutions may reinforce the idea that the art is satisfied with the status quo and not interested in alternate solutions.
10. Common Sense. Proposed definitions of common sense are set forth below.

A. The People In Common (PIC) definition: "The earth is flat".

One definition of common sense is what people in common would agree upon, that which they "sense" as their common natural understanding or would consider in most people's experience to be prudent and of sound judgment. This definition assumes a country with a population with a particular baseline language, customs and knowledge. The baseline knowledge is knowledge available and known by a large majority of the population, and is knowledge that typically does not require specialized knowledge or study; such baseline knowledge can change over time depending on the success of educational institutions, changing societal climes, etc. Under the people in common (PIC) definition, common sense often has been wrong and, for example, at one time held that the earth was flat. Even today it evidently is estimated that 60% of the people on earth believe the sun revolves around the earth. Others today use "common sense" to make the judgment that heavier bodies fall faster than light bodies.

B. The Common Man Sound Judgment (CMSJ) definition. A second definition of common sense is sound judgment based on a simple perception of the situation or facts. Sound judgment means sensible judgment based on valid reasoning. This suggests that a common sense judgment, if reliable, is subject to evaluation to see if there are reasons or criteria that support and justify the judgment. This definition assumes a country with a population with a particular baseline language, customs and knowledge. The baseline knowledge is knowledge available and known by a large majority of the population, and is knowledge that typically does not require specialized knowledge or study; such baseline knowledge can change overtime depending on the success of educational institutions, changing societal climes, etc. What might be common sense to an American might not be common sense to a person living in another country. An individual could move to the United States from India and what might appear common sense to an American would, because of the culture of India, make absolutely no sense to the Indian. In evaluating obviousness, however, it is usually, for better or worse, assumed that the Indian has the same baseline knowledge as individuals who have grown up in the United States.

C. The Ordinary Skill Sound Judgment (OSSJ) definition. A third definition of common sense is sound judgment by one of ordinary skill in the art based on a perception of the situation or facts in the context of the baseline knowledge in CMSJ and of specialized knowledge that is over and above said baseline knowledge and is attributed to one of ordinary skill in the art. As noted, sound judgment means sensible judgment based on valid reasoning. This suggests that a common sense judgment by one or ordinary skill in the art is, if reliable, subject to evaluation to see if there are reasons or criteria that support and justify the judgment. This definition assumes a country with a population with a particular baseline language, customs and knowledge. The baseline knowledge and specialized knowledge comprise knowledge available and known by a large majority of those of skill in the art; such baseline knowledge and specialized knowledge can change overtime depending on the success of educational institutions, advances in the art, changing societal climes, etc. What might be common sense to an American of ordinary skill in the art might not be common sense to a person that lives in another country and appears to be one of ordinary skill in the art. In evaluating obviousness, however, it is usually, for better or worse, assumed that the person of ordinary skill in the art from India has the same baseline knowledge as individuals of skill in the art who have grown up in the United States. In some technically simple inventions, the ordinary skill sound judgment (OSSJ) may be commensurate with common man sound judgment (CMSJ) because there is little if any specialized knowledge required. For example, a new Christmas tree ornament design might not require any particular specialized knowledge over and above the baseline knowledge of the large majority of people. In contrast, many inventions obviously require a specialized knowledge over and above commonly held baseline knowledge, in which case such specialized knowledge will be utilized in the sound reasoning involved in ordinary skill sound judgment common sense.

As used herein, relying on common sense judgment requires that valid reasoning justifying such judgment be set forth. Hence, the common man sound judgment (CMSJ) and ordinary skill sound judgment (OSSJ) definitions are generally relied on herein in determining the obviousness of an invention.

11. Assessment of Trends. As used herein a trend is a general inclination or tendency. A trend generally (1) occurs over an extended period of time, (2) occurs by or within a large number of individual in the pertinent art, and (3) is often can be demonstrated by the existence of a significant number of printed references and by personal knowledge of those in the art. With respect to (1) above in this paragraph, a general inclination that lasts a short period of time, for example a day or a month, typically does not constitute a trend. With respect to (2) above in this paragraph, if only a few individuals demonstrate a general inclination or tendency, such typically does not comprise a trend. With respect to (3) above in this paragraph, if there are only a few documents that demonstrate a particular inclination or tendency, such typically does not demonstrate a trend.

The weight or importance of a trend in leading to an invention is evaluated by assessing (1) the length of time during which the trend has existed, (2) the number of individuals that believed or followed the trend, (3) the number of references that describe the trend, (4) the existence of other similar or related trends that might obfuscate or invalidate a trend and make it unlikely to lead to the invention, and (5) the existence of countervailing trends. If a trend is "buried" among many comparable trends in the art, it becomes more unlikely that one of ordinary skill will notice or utilize the trend. If a trend is overshadowed by countervailing trends, it becomes more unlikely that one of ordinary skill will notice of utilize the trend.

11. Assessing an Equivalent. As used herein, an equivalent is a structure or a system that is functionally or structurally equivalent to another structure or system. In determining whether it is obvious to substitute one "equivalent" for another, the following must be evaluated. First, is what is being substituted truly an equivalent? Is it functionally or structurally equivalent to what is being replaced? Second, if the equivalent is functionally or structurally equivalent, is it only structurally equivalent or only functionally equivalent? If it is only one or the other, this reduces the likelihood the equivalent would be used. Third, did the equivalent, or the invention, have to be modified to use the equivalent? If so, this reduces the likelihood the equivalent would be utilized. Fourth, is it likely the equivalent would be considered by one of ordinary skill in the art? If a new Christmas ornament utilizes a laminate including an outer protection coating from a prior Christmas ornament and substitutes that coating as an "equivalent" for the outer protective coating in another known Christmas ornament, then it arguably is likely that such a substitution would be considered by one of skill in the art. On the other hand, if the first substitute coating is normally found in a nuclear reactor in a submarine, it may be very unlikely, almost incredible, that such a coating would be considered and a substitution would be made. Simply stating that it would be known by one of skill in the art to substitute an equivalent is not, without providing reasons, believed sufficient. Otherwise such a generalized rationale could be used to invalidate most, if not all, patents known to man.

Having set forth my invention in terms to enable those skilled in the art to understand and practice the invention and having set forth the presently preferred embodiments and uses thereof, I claim:

1. A scuba diving propulsion system comprising a propulsion apparatus for a tank, said propulsion apparatus comprising (a) a bracket;

(b) apparatus securing said bracket to said tank;

(c) a battery mounted on said bracket;

(d) a motive power module mounted on said bracket and including a self-contained electric motor unit including a first housing, a self-contained transmission unit including a second housing, mounted exterior of said first housing, and operatively associated with said motor unit to increase and transmit the torque produced by said motor unit, a self-contained clutch unit including a third housing, mounted exterior of said first and second housings, and operatively associated with said transmission to transmit torque produced by said transmission unit, a propeller shaft operatively associated with said transmission unit and clutch unit to receive torque produced by said transmission unit and to rotate, said shaft including a proximate end operatively associated with said clutch unit, and a distal end, and a propeller mounted on said distal end of said propeller shaft, said clutch disengaging said transmission unit in the event rotation of said propeller and shaft is prevented while said motor unit and transmission unit are producing torque.

* * * * *